US008084703B2

(12) United States Patent
Hisamune et al.

(10) Patent No.: US 8,084,703 B2
(45) Date of Patent: Dec. 27, 2011

(54) ROTATING OPERATION TYPE ELECTRONIC COMPONENT, AND ELECTRONIC DEVICE INCLUDING THE SAME

(75) Inventors: Hiroaki Hisamune, Okayama (JP); Jun Sato, Okayama (JP); Akira Matsumoto, Okayama (JP)

(73) Assignee: Panasonic Corporation, Osaka (JP)

( * ) Notice: Subject to any disclaimer, the term of this patent is extended or adjusted under 35 U.S.C. 154(b) by 508 days.

(21) Appl. No.: 12/335,750

(22) Filed: Dec. 16, 2008

(65) Prior Publication Data

US 2009/0152086 A1 Jun. 18, 2009

(30) Foreign Application Priority Data

Dec. 18, 2007 (JP) ..... 2007-325567
Aug. 21, 2008 (JP) ..... 2008-212332

(51) Int. Cl.
*H01H 85/00* (2006.01)

(52) U.S. Cl. ..... 200/336; 200/61.08

(58) Field of Classification Search ..... 200/61.08, 200/334, 336, 341, 566, DIG. 22, 345
See application file for complete search history.

(56) References Cited

U.S. PATENT DOCUMENTS 7,180,024 B2 * 2/2007 Sugita ..... 200/341
7,208,690 B1 * 4/2007 Kodani ..... 200/336

FOREIGN PATENT DOCUMENTS

JP 2005-302354 10/2005

* cited by examiner

*Primary Examiner* — Anh Mai
*Assistant Examiner* — Lisa Klaus
(74) *Attorney, Agent, or Firm* — Webderoth, Lind & Ponack, L.L.P.

(57) ABSTRACT

A rotating operation type electronic component has a rotation shaft and a signal generating section. The rotation shaft has a rod-shaped intermediate section, a cylindrical operation section, and a coupling section coupling the upper end of the intermediate section with the operation section. The rotatable operation section covers the upper part of the intermediate section, and has an operation knob mounted thereon. The signal generating section generates an electric signal in response to the rotation of the operation section. The coupling section has strength at which it breaks when a load of a predetermined level or higher is applied to the operation section from an axial direction of the rotation shaft.

13 Claims, 11 Drawing Sheets

ROTATING OPERATION TYPE ELECTRONIC COMPONENT, AND ELECTRONIC DEVICE INCLUDING THE SAME

BACKGROUND OF THE INVENTION

1. Field of the Invention

The present invention relates to a rotating operation type electronic component used in an input operation section of an on-vehicle electronic device such as a car audio, and an electronic device including the electronic component.

2. Background Art

Recently, in order to secure the safety of a driver and a fellow passenger, demand for safety improvement also in various on-vehicle electronic devices has increased. As an input operation section of such an electronic device, a rotating operation type encoder that is one of rotating operation type electronic components is used. A conventional rotating operation type encoder is described hereinafter with reference to FIG. 11.

FIG. 11 is a sectional view of the conventional rotating operation type encoder. Case 41 made of insulating resin is provided with an opening in an upper part thereof. A pair of fixed contacts 42 for a push-on switch are disposed at the center position on the bottom surface of the open and recessed section. Cylindrical wall 41A is disposed so as to surround a peripheral position of fixed contacts 42. Contact pattern 43 for an incremental encoder is disposed on the bottom surface of case 41 outside cylindrical wall 41A. Electrically conductive terminals 44 are connected to fixed contacts 42 and contact pattern 43, respectively. Each terminal 44 is extended out of case 41.

The pair of fixed contacts 42 are formed of center fixed contact 42A disposed in the center and outer fixed contact 42B disposed outside separately from center fixed contact 42A. Movable contact 45 is combined with fixed contacts 42. The outer periphery of movable contact 45 is mounted on outer fixed contact 42B, and the center part of movable contact 45 faces center fixed contact 42A while a clearance is left between them.

Elastic body 46 made of silicone rubber or the like is mounted on the outer periphery of movable contact 45. Elastic body 46 has central columnar section 46A and conical section 46B that is open downward and is disposed under columnar section 46A. Conical section 46B is regulated in its position on the inner surface of cylindrical wall 41A, to form a push-on switch.

Rotor 47 has cylindrical section 47A, and circular flange 47B disposed under cylindrical section 47A. A center hole in rotor 47 is noncircular. Slide piece 48 is disposed on the lower surface of flange 47B, and the tip of slide piece 48 is elastically in contact with contact pattern 43. Thus, an incremental encoder section is formed.

Bushing 49 has collar 49B, and the lower surface of collar 49B is mounted on the upper surface of case 41. Cylindrical section 49C that has a substantially cylindrical shape and projects upward is disposed in the center position of bushing 49. The diameter of a lower part of intermediate hole 49A is larger than that of an upper part thereof. Cylindrical section 47A of rotor 47 is rotatably combined with bushing 49 at the larger-diameter part.

Substantially rod-shaped rotation shaft 50 has operation section 50A, intermediate section 50B, and engaging section 50C. Operation section 50A is positioned above bushing 49, and a part positioned under operation section 50A is inserted into intermediate hole 49A of bushing 49 from above Intermediate section 50B having a circular cross section is engaged with bushing 49 at the upper end of intermediate hole 49A, so that rotation shaft 50 is disposed rotatably and vertically movably. Engaging section 50C positioned under intermediate section 50B is inserted into a noncircular hole of driving die 51 in an engaging state. The lower end of engaging section 50C is in contact with the upper surface of columnar section 46A of elastic body 46. Rotation shaft 50 is pressed upward by elastic force of elastic body 46.

Driving die 51 is caulked and fixed to engaging section 50C of rotation shaft 50, and is disposed in cylindrical section 47A of rotor 47. Since rotation shaft 50 is pressed upward, driving die 51 is also pressed upward and pressed onto the inner surface of cylindrical section 47A. Thus, rotation shaft 50 is engaged with rotor 47 by the elastic force of elastic body 46, and hence rotor 47 rotates via driving die 51 when rotation shaft 50 is rotated without being pressed downward.

A bending part of leaf spring 52 for click is elastically in contact with an uneven part disposed on the upper surface of flange 47B. When rotor 47 rotates, the bending part of leaf spring 52 slides on the uneven part and generates click feeling.

Cover 53 is mounted so as to envelop case 41 from the upper surface of collar 49B of bushing 49. Thus, a conventional rotating operation type encoder is formed.

When operation section 50A is rotated, rotor 47 is rotated through driving die 51 caulked and fixed to engaging section 50C. Slide piece 48 disposed on the lower surface of flange 47B of rotor 47 slides on contact pattern 43 on case 41. When slide piece 48 makes contact with and separates from contact pattern 43, a pulse signal is output from corresponding terminal 44 of the incremental encoder section. When leaf spring 52 slides on the uneven part disposed on the upper surface of flange 47B in response to rotation of rotor 47, the click feeling is generated.

When operation section 50A is pressed, rotation shaft 50 moves downward, and engaging section 50C and driving die 51 move downward in the noncircular center hole of rotor 47. Therefore, the engaging state of rotor 47 with rotation shaft 50 is disappeared. Engaging section 50C presses the upper surface of columnar section 46A of elastic body 46 that is in contact with its lower end. When the pressing force exceeds a predetermined value, conical section 46B of elastic body 46 elastically buckles and deforms. In response to this deformation, a projection disposed on the lower surface of columnar section 46A presses the center part of movable contact 45. Thus, the center part of movable contact 45 comes into contact with center fixed contact 42A. As a result, outer fixed contact 42B is electrically conducted with center fixed contact 42A, thereby putting the push-on switch into the ON state. During vertical movement of rotation shaft 50 by the pressing operation, rotor 47 is kept in a stopping state.

As shown by broken lines in FIG. 11, when this rotating operation type encoder is mounted to an electronic device, operation knob 60 is attached to operation section 50A. A user of the electronic device rotates operation knob 60 to operate the incremental encoder section. The user presses operation knob 60 to operate the push-on switch. Using a signal obtained by each of these operations, the user operates a relevant function of the electronic device into a desired state.

In many electronic devices, the projection length of operation knob 60 from the operation panel surface is set to about 13-17 mm so that a user easily operates operation knob 60. While, when a rotating operation type electronic component is used in an input operation section of an on-vehicle electronic device, the projection length of operation knob 60 from the operation panel surface is required to be shorter. This is a safety measure for safety in the event of an accident such as vehicle collision. This prevents a human body from being injured by an operation part projecting from the operation panel surface. In an on-vehicle electronic device in Europe, for example, the specified value of the projection length of operation knob 60 from the operation panel surface is set to 9.5 mm, and the projection length is required to be this specified value or shorter.

When the projection length of operation knob 60 is the specified value or shorter, however, it is difficult for a user to operate it. Therefore, in many cases, operation knob 60 projects longer than the specified value. These cases require a structure where projecting operation knob 60 drops down to the specified value or lower when an excessive load is applied to operation knob 60.

In the conventional rotating operation type encoder, however, even when an excessive load is applied to operation knob 60, rotation shaft 50 simply moves down by the operation distance of the push-on switch. Therefore, the dropping allowance cannot be absorbed by the rotating operation type encoder itself. Therefore, a mechanism for absorbing the dropping allowance has to be on the electronic device side. In the electronic device, however, the space is further saved and mounting density is higher, and hence it is often difficult to dispose such a mechanism.

SUMMARY OF THE INVENTION

The present invention provides a rotating operation type electronic component capable of securing the dropping allowance of an operation part when an excessive load is applied to the operation part, and provides an electronic device including the electronic component.

The rotating operation type electronic component of the present invention has a rotation shaft and a signal generating section. The rotation shaft has a rod-shaped intermediate section, a cylindrical operation section, and a coupling section coupling the upper end of the intermediate section with the operation section. The rotatable operation section covers the upper part of the intermediate section, and is mounted with an operation knob. The signal generating section generates an electric signal in response to the rotation of the operation section. The coupling section has a strength such that it breaks when a load of a predetermined level or higher is applied to the operation section from an axial direction of the rotation shaft. In this structure, the coupling section of the rotation shaft is broken by the excessive load, and the operation section drops along a direction of the load. Therefore, a mechanism is not required that absorbs the dropping size of the operation knob on an electronic device to which the electronic component is mounted.

DETAILED DESCRIPTION OF THE INVENTION

A rotating operation type electronic component of the present invention will be described hereinafter with reference to the accompanying drawings, taking a rotating operation type encoder as an example.

First Exemplary Embodiment

Figure 1:
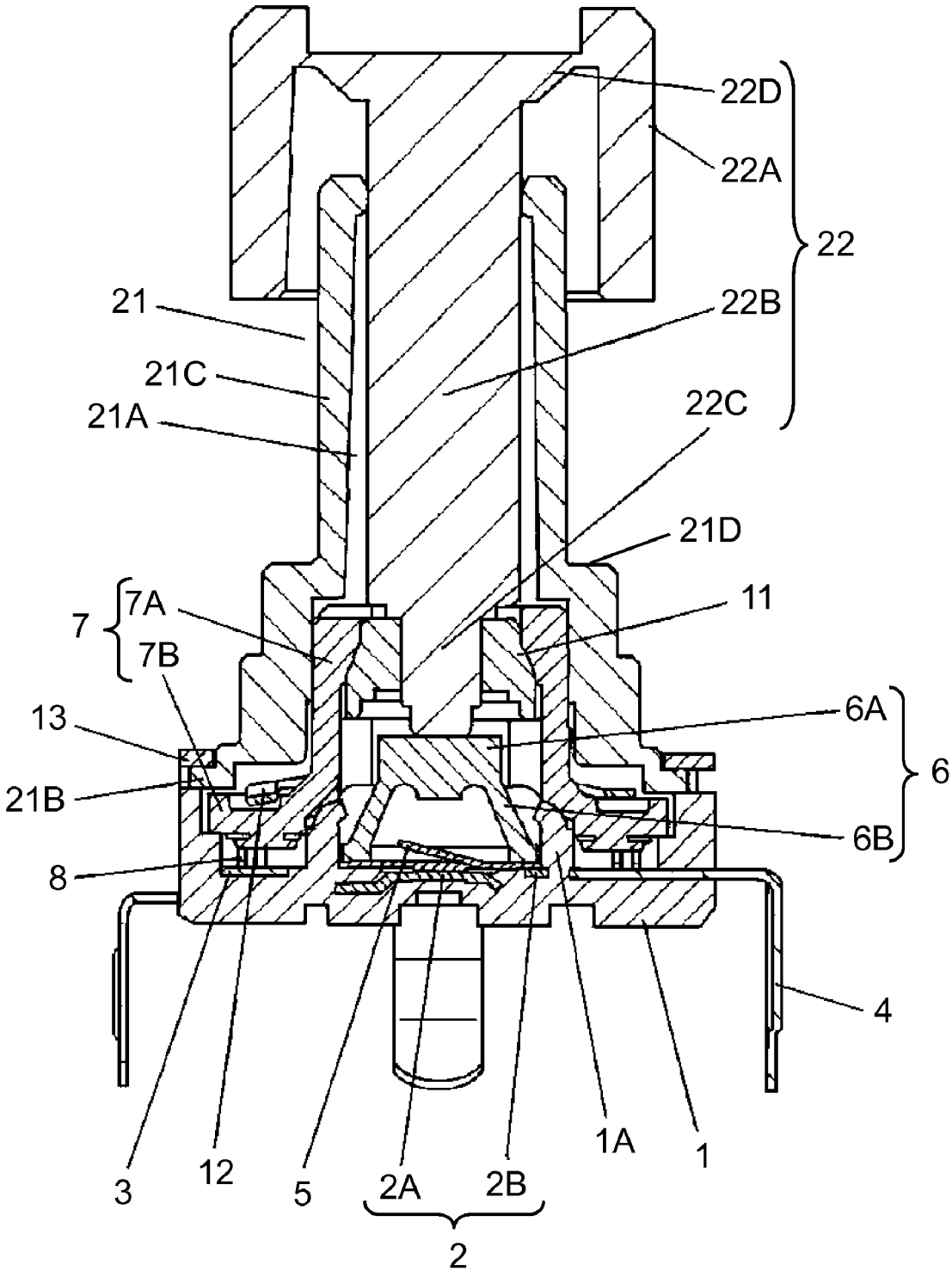
FIG. 1 is a sectional view of a rotating operation type encoder as a rotating operation type electronic component in accordance with a first exemplary embodiment of the present invention.
Figure 2:
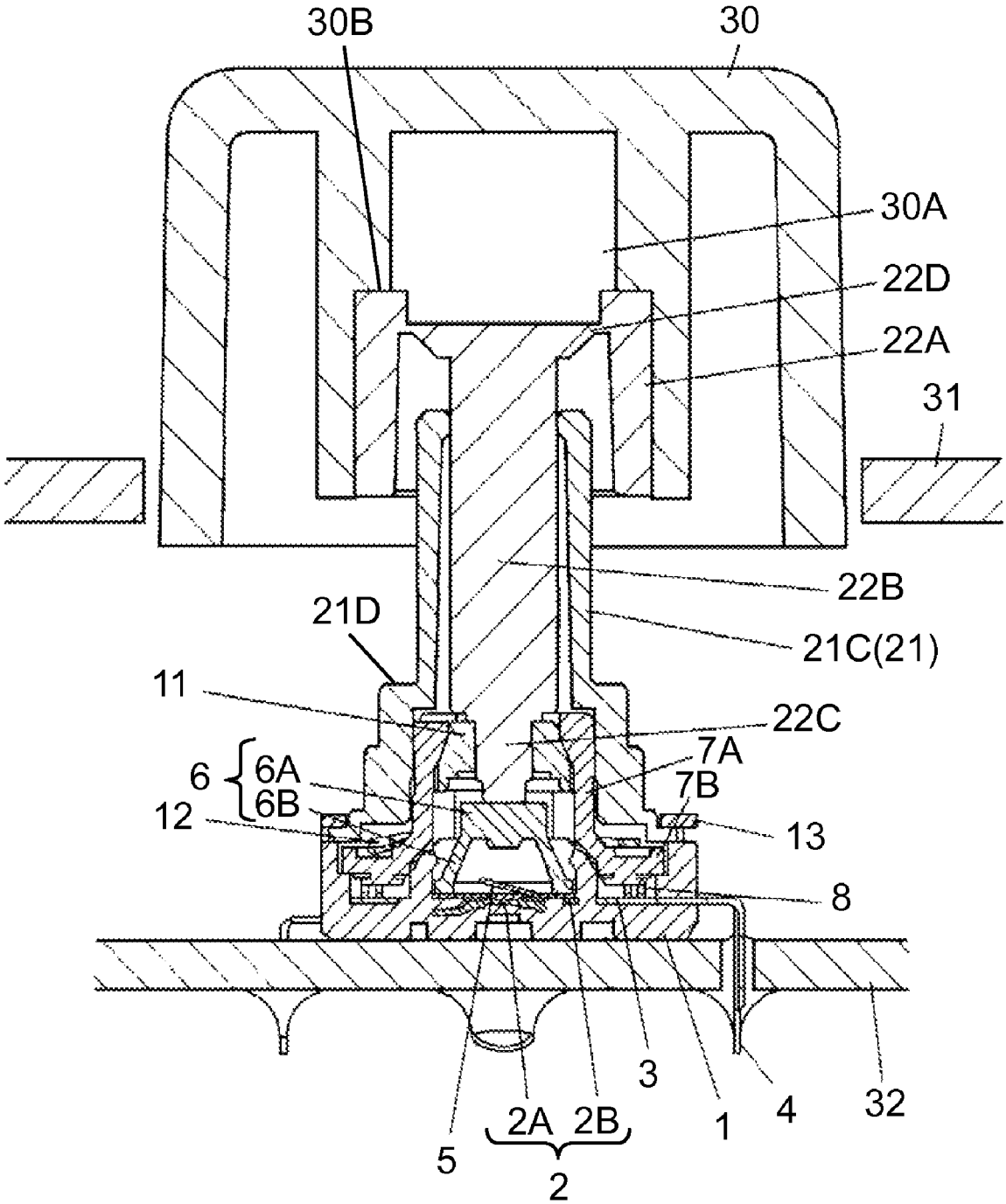
FIG. 2 is a sectional view of an essential part of an electronic device mounted with the rotating operation type encoder shown in FIG. 1.
Figure 3:
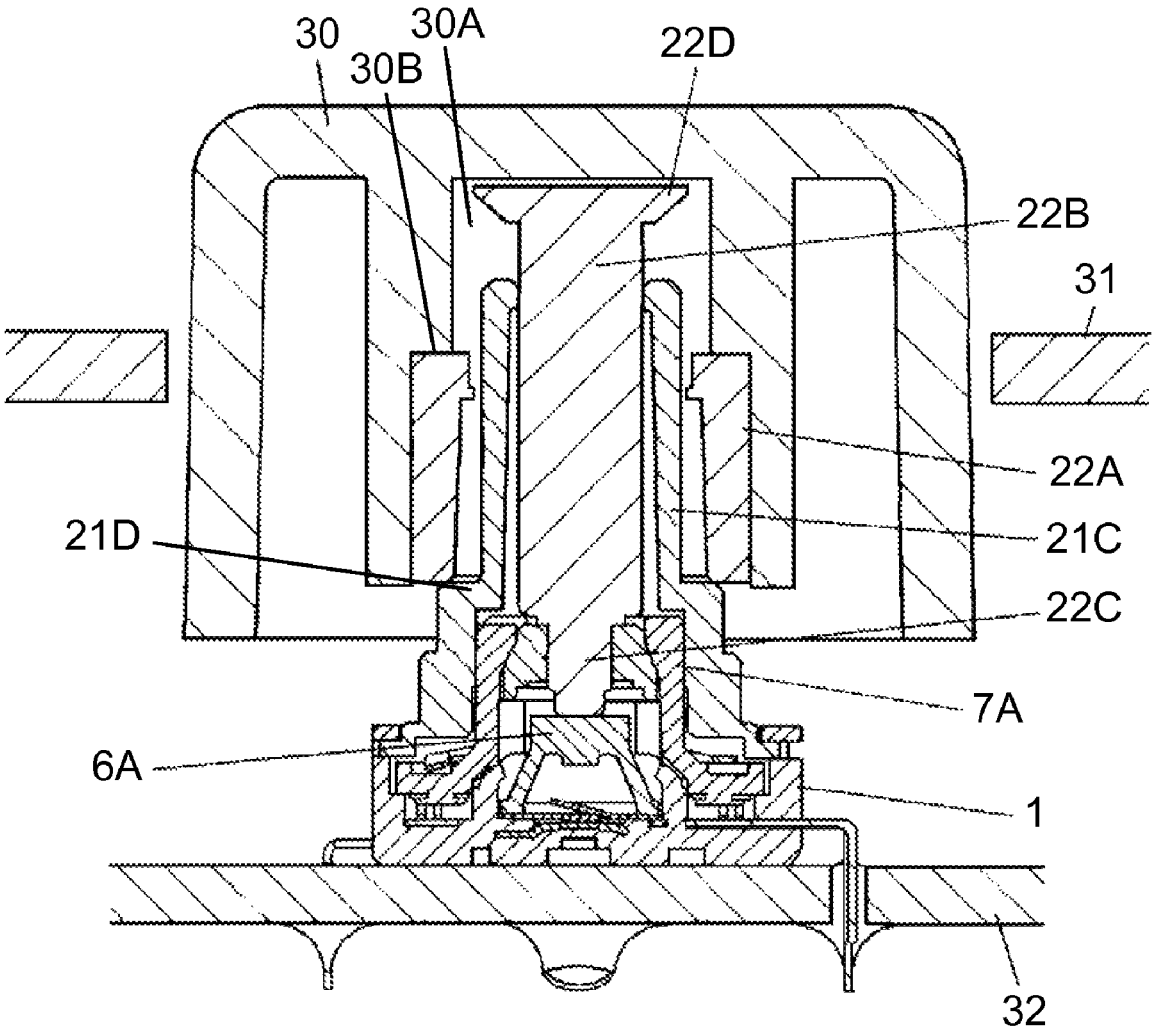
FIG. 3 is a sectional view of an essential part of a dropping state of an operation knob in the electronic device shown in FIG. 2.

FIG. 1 is a sectional view of a rotating operation type encoder in accordance with a first exemplary embodiment of the present invention. FIG. 2 is a sectional view of an essential part of an electronic device mounted with the rotating operation type encoder. FIG. 3 is a sectional view of an essential part of a dropping state of an operation knob in the electronic device. As shown in FIG. 1, the rotating operation type encoder has case 1, bushing 21, rotation shaft 22, driving die 11, rotor 7, and a signal generating section formed of contact pattern 3 and slide piece 8. The rotating operation type encoder also has elastic body 6, a push-on switch formed of fixed contacts 2 and movable contact 5, and cover 13.

Rotation shaft 22 has cylindrical operation section 22A, rod-shaped intermediate section 22B, engaging section 22C, and coupling section 22D. Operation section 22A covers the upper part of intermediate section 22B. Coupling section 22D couples the upper end of intermediate section 22B with operation section 22A. Operation section 22A is rotatable. Rotation shaft 22 is movable in an axial direction thereof. Coupling section 22D has strength at which it breaks when a load of a predetermined level or higher is applied to operation section 22A from the axial direction of rotation shaft 22.

Case 1 is made of insulating resin and is open at its upper end. A pair of fixed contacts 2 forming the push-on switch are disposed at the center position on the bottom surface of an open and recessed section. Cylindrical wall 1A is disposed so as to surround a peripheral position of fixed contacts 2. Contact pattern 3 forming the signal generating section is disposed on the bottom surface of case 1 outside cylindrical wall 1A. Terminals 4 are connected to fixed contacts 2 and contact pattern 3, respectively in an electrically conductive manner. Each terminal 4 is extended out of case 1.

Fixed contacts 2 are formed of center fixed contact 2A disposed in the center and outer fixed contact 2B disposed outside separately from center fixed contact 2A. Movable contact 5 is combined with fixed contacts 2. The outer periphery of movable contact 5 is mounted on outer fixed contact 2B, and the center part of movable contact 5 faces center fixed contact 2A while a clearance is left between them.

Elastic body 6 made of silicone rubber or the like is mounted on the outer periphery of movable contact 5. Elastic body 6 has central columnar section 6A and conical section 6B that opens downward and is disposed under columnar section 6A. Conical section 6B is regulated in its position on the inner surface of cylindrical wall 1A, to form the push-on switch.

Rotor 7 has cylindrical section 7A, and circular flange 7B disposed under cylindrical section 7A. A center hole in rotor 7 is noncircular. Slide piece 8 is disposed on the lower surface of flange 7B, and the tip of slide piece 8 is elastically in contact with contact pattern 3. Thus, the signal generating section is formed. In the present embodiment, the signal generating section generates an electric signal in response to the rotation of operation section 22A, and is an incremental encoder section.

Bushing 21 has collar 21B and cylindrical section 21C. The lower surface of collar 21B is mounted on the upper surface of case 1. Cylindrical section 21C is disposed in the center position of bushing 21, has a substantially cylindrical shape, and projects upward. The diameter of a lower part of intermediate hole 21A is larger than that of an upper part thereof. Cylindrical section 7A of rotor 7 is rotatably combined with bushing 21 at the larger-diameter part.

Operation section 22A of rotation shaft 22 is positioned at the same level of the upper part of bushing 21, and a part positioned under operation section 22A is inserted into intermediate hole 21A of bushing 21 from above. Intermediate section 22B having a circular cross section is engaged with bushing 21 at the upper end of intermediate hole 21A, and rotation shaft 22 is disposed rotatably and vertically movably. Engaging section 22C positioned under intermediate section 22B is inserted into a noncircular hole of driving die 11 in an engaging state. The lower end of engaging section 22C is in contact with the upper surface of columnar section 6A of elastic body 6. Rotation shaft 22 is pressed upward by the elastic force of elastic body 6.

Driving die 11 is caulked and fixed to engaging section 22C of rotation shaft 22, and is disposed in cylindrical section 7A of rotor 7. Since rotation shaft 22 is pressed upward, driving die 11 is also pressed upward and pressed onto the inner surface of cylindrical section 7A. Thus, rotation shaft 22 is engaged with rotor 7 by the elastic force of elastic body 6, and hence rotor 7 rotates via driving die 11 when rotation shaft 22 is rotated without being pressed downward.

A bending part of leaf spring 12 is elastically in contact with an uneven part disposed on the upper surface of flange 7B. When rotor 7 rotates, the bending part of leaf spring 12 slides on the uneven part and generates click feeling.

Cover 13 is mounted so as to envelop case 1 from the upper surface of collar 21B of bushing 21. Thus, a rotating operation type encoder is formed.

When operation section 22A rotates, rotor 7 is rotated through driving die 11 caulked and fixed to engaging section 22C. Slide piece 8 disposed on the lower surface of flange 7B of rotor 7 slides on contact pattern 3 on case 1. When slide piece 8 makes contact with and separates from contact pattern 3, a pulse signal is output from corresponding terminal 4 of the incremental encoder section. When leaf spring 12 slides on the uneven part disposed on the upper part of flange 7B in response to the rotation of rotor 7, the click feeling is generated.

When operation section 22A is pressed, rotation shaft 22 moves downward, and engaging section 22C and driving die 11 move downward in the noncircular center hole of rotor 7. Therefore, the engaging state of rotor 7 with rotation shaft 22 is removed. Engaging section 22C presses the upper surface of columnar section 6A of elastic body 6 that is in contact with its lower end. When the pressing force exceeds a predetermined value, conical section 6B of elastic body 6 elastically buckles and deforms. In response to this deformation, a projection disposed on the lower surface of columnar section 6A presses the center part of movable contact 5. Thus, the center part of movable contact 5 comes into contact with center fixed contact 2A. As a result, outer fixed contact 2B is electrically conducted with center fixed contact 2A, thereby putting the push-on switch into the ON state. During vertical movement of rotation shaft 22 by the pressing operation, rotor 7 is kept in a stopping state.

As shown in FIG. 2, when this rotating operation type encoder is mounted to an electronic device, operation knob 30 is attached to operation section 22A. A user of the electronic device rotates operation knob 30 to operate the incremental encoder section. The user presses operation knob 30 to operate the push-on switch. Using a signal obtained by each of these operations, the user operates a relevant function of the electronic device into a desired state.

Next, a characteristic structure of the rotating operation type encoder of the present embodiment is described. The length of cylindrical section 21C of bushing 21 is set slightly longer than cylindrical section 49C of the conventional rotating operation type encoder. Intermediate section 22B of rotation shaft 22 is coupled to operation section 22A through coupling section 22D. In other words, coupling section 22D is disposed in the upper end of intermediate section 22B that is engaged and supported by bushing 21 and projects from intermediate hole 21A, and is connected to the inner wall part of substantially cylindrical operation section 22A.

Coupling section 22D has a circular and substantially flat shape, is formed so that the vertical thickness decreases toward the outer edge of the circle, and is connected to operation section 22A. The thickness of the ring-like thinnest part is constant over the entire circumference.

Next, an electronic device mounted with the above-mentioned rotating operation type encoder is described. In FIG. 2, the rotating operation type encoder shown in FIG. 1 is soldered and fixed to wiring board 32. Wiring board 32 has a circuit section connected to the signal generating section of the rotating operation type encoder. Operation knob 30 is mounted to operation section 22A of the rotating operation type encoder. The upper part of operation knob 30 is projected from operation panel 31 of the electronic device. Operation knob 30 is projected from operation panel 31 by about 15 mm, namely a size that is easy to operate with fingers of a user of the electronic device.

Operation knob 30 has stepped and recessed section 30A opening downward in the center of the lower surface. A part positioned under step section 30B is engaged with operation section 22A so as to cover the outer periphery of operation section 22A.

In the rotating operation type encoder mounted on the electronic device, when an excessive load of a predetermined level or higher is applied to operation knob 30 from the axial direction of rotation shaft 22, the thinnest part of coupling section 22D is broken. In other words, operation knob 30 can drop into operation panel 31 together with operation section 22A, as shown in FIG. 3.

It is preferable that the thinnest part of coupling section 22D is positioned outside the outer diameter of cylindrical section 21C of bushing 21. In other words, it is preferable that the inner diameter of the part of operation section 22A that is coupled to intermediate section 22B through coupling section 22D is larger than the outer diameter of cylindrical section 21C. It is preferable that the vertical thickness of coupling section 22D is the smallest at the position outside the outer periphery of cylindrical section 21C. As discussed above, the upper end of intermediate section 22B projects from bushing 21. Therefore, when coupling section 22D is formed as discussed above, the thin part of coupling section 22D can be specified as a breaking part. In addition, operation section 22A thus released from intermediate section 22B engages with cylindrical section 21C as a positional relation. Therefore, the dropping distance of operation section 22A can be arbitrarily set by varying the length of cylindrical section 21C.

Step section 30B of stepped and recessed section 30A of operation knob 30 is in contact with the upper surface of operation section 22A. It is preferable that the inner diameter of the part of the recessed section that is positioned above step section 30B is equal to or larger than the inner diameter of operation section 22A.

When coupling section 22D is broken, the part of the recessed section positioned above step section 30B serves as a clearance part of coupling section 22D remaining at the upper end of intermediate section 22B. Therefore, when coupling section 22D is broken by an excessive load, operation knob 30 and operation section 22A drop down.

When the inner diameter of the part of the recessed section positioned above step section 30B is equal to or larger than the inner diameter of operation section 22A, the part of the recessed section positioned above step section 30B certainly serves as a clearance part of coupling section 22D remaining at the upper end of intermediate section 22B when coupling section 22D is broken. However, the inner diameter of the part of the recessed section positioned above step section 30B is required to be larger than the outer diameter of coupling section 22D to be broken.

When the inner diameter of the part of the recessed section positioned above step section 30B is larger than the outer diameter of cylindrical section 21C of bushing 21, operation knob 30 and operation section 22A drop down without being affected by cylindrical section 21C. Therefore, it is preferable that the inner diameter of the part of the recessed section positioned above step section 30B is larger than the outer diameter of cylindrical section 21C. When cylindrical section 21C is set longer than conventional cylindrical section 49C, the dropping distance of operation knob 30 can be sufficiently secured.

It is preferable that the depth of the part of the recessed section positioned above step section 30B is greater than the required dropping distance of operation knob 30. As shown in FIG. 3, it is preferable that the lower end of operation section 22A abuts on step section 21D with a diameter larger than that of operation section 22A in bushing 21, thereby stopping operation knob 30. In other words, the sum of the depth of the part of the recessed section positioned above step section 30B and the height of operation section 22A is preferably larger than the height from step section 21D to the upper surface of coupling section 22D remaining at the upper end of intermediate section 22B when coupling section 22D is broken. Thus, the upper surface of coupling section 22D remaining at the upper end of intermediate section 22B of rotation shaft 22 does not abut against operation knob 30.

As discussed above, when an excessive load is applied to operation knob 30 or operation section 22A of rotation shaft 22, coupling section 22D is broken and operation knob 30 significantly drops. Therefore, the projection length of operation knob 30 from operation panel 31 can be shortened. At this time, the length of the cylindrical section 21C of bushing 21 is required to be set in response to a required dropping distance of operation knob 30. Thanks to this structure, the electronic device to be mounted with the rotating operation type encoder is not required to have a structure for absorbing the dropping distance.

Figure 4:
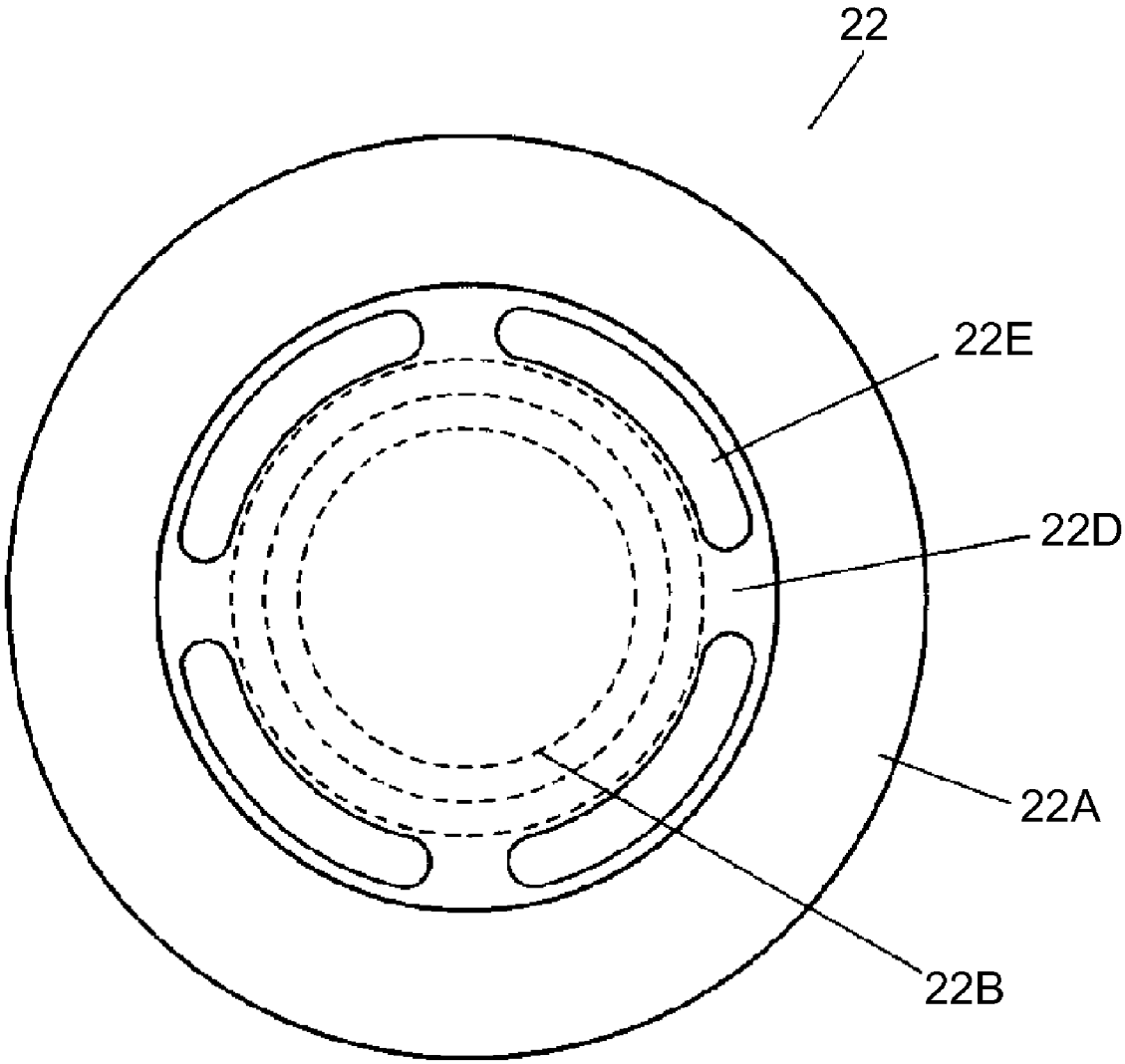
FIG. 4 is a top view of a rotation shaft used in another rotating operation type encoder in accordance with the first exemplary embodiment of the present invention.

Coupling section 22D to couple operation section 22A of rotation shaft 22 to intermediate section 22B may have the shape shown in FIG. 4. In this structure, a plurality of through holes 22E are disposed in coupling section 22D at constant intervals along the circumference direction. In FIG. 4, four through holes 22E are disposed, and coupling section 22D couples operation section 22A to intermediate section 22B at four positions every 90°. The number of coupling positions of coupling section 22D and the shape of through holes 22E are required to be determined appropriately in consideration of the set value of the load for breaking coupling section 22D.

Also when through holes 22E are disposed, coupling section 22D is broken by a load of a predetermined level or higher that is applied to operation section 22A from the axial direction of rotation shaft 22. In this structure, the thickness of coupling section 22D is not required to be extremely decreased. Therefore, rotation shaft 22 is easily managed when it is manufactured, and breakage or the like of coupling section 22D by a load partially applied to it can be reduced when rotation shaft 22 is singly handled. As a result, the handling property of rotation shaft 22 is improved, and production efficiency is also improved.

As coupling section 22D, the structure where a thin part is disposed and the structure where through holes 22E are disposed have been described. However, both of the structures may be combined.

Figure 5:
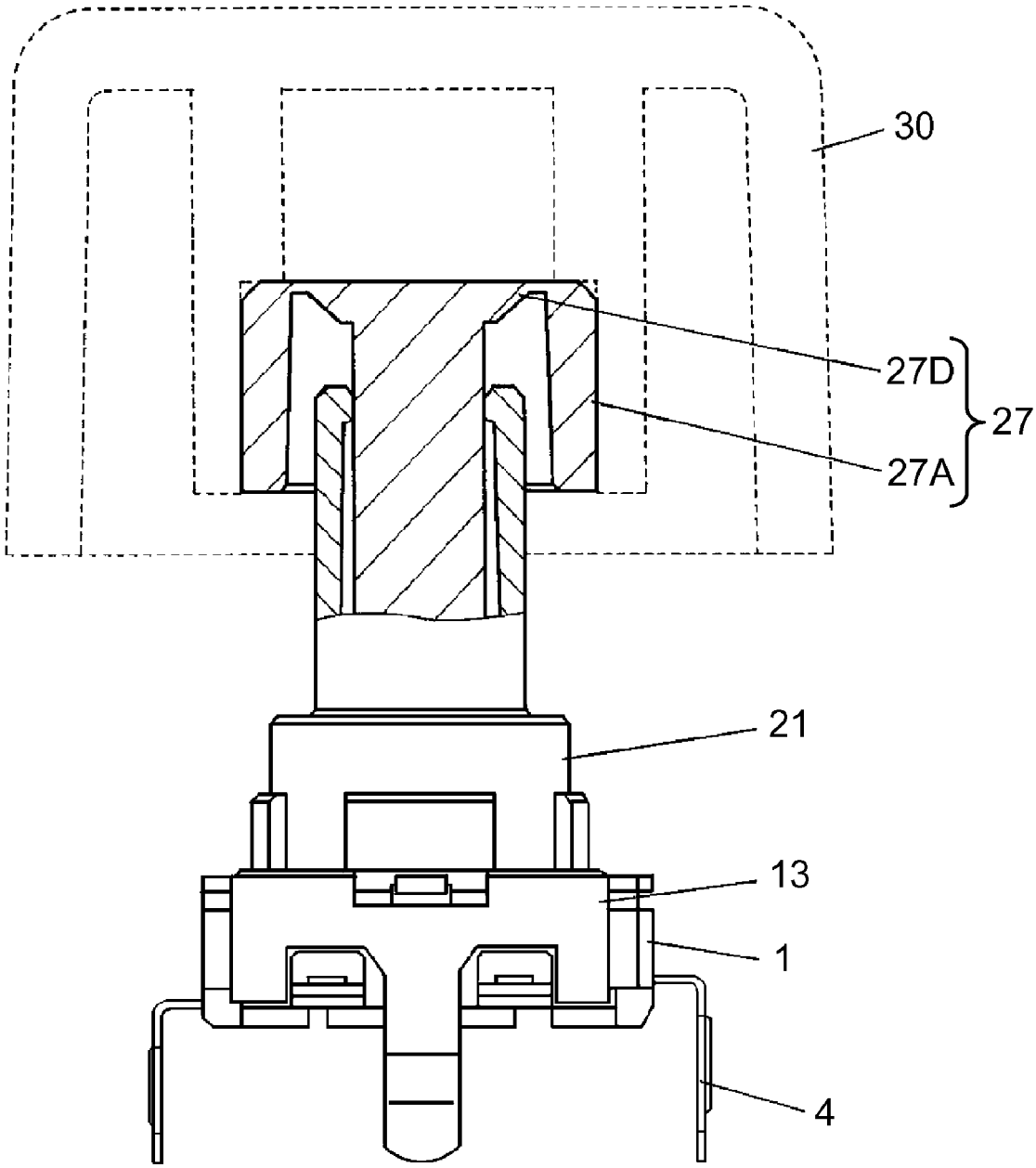
FIG. 5 is a sectional view of an essential part of still another rotating operation type encoder as a rotating operation type electronic component in accordance with the first exemplary embodiment.

In FIG. 1 through FIG. 4, the upper surface of operation section 22A of rotation shaft 22 projects upward in an outer periphery that forms the outside of coupling section 22D. However, the present invention is not limited to this. FIG. 5 is a sectional view of an essential part of another rotating operation type encoder as a rotating operation type electronic component in accordance with the first exemplary embodiment.

In the structure shown in FIG. 5, rotation shaft 27 is formed of zinc alloy by die-casting, and the upper surface of operation section 27A of rotation shaft 27 has a flat shape. At a predetermined load in normal use, rotation shaft 27 hardly deforms and coupling section 27D does not break. When an excessive load due to an impact or the like is applied, thin coupling section 271) breaks. Rotation shaft 27 having such a structure is made of appropriate material, and the upper surface of operation section 27A has a simple shape, so that the structure of the die-casting die can be simplified. In addition, the area from the outer peripheral end of the upper surface of operation section 27A to the root of thin coupling section 27D can be formed on the same surface. Therefore, this structure is preferable because a ring-like range wider than rotation shaft 22 of FIG. 1 can be interpolated into operation knob 30.

Second Exemplary Embodiment

A rotating operation type electronic component of a second exemplary embodiment will be described hereinafter with reference to FIG. 6 through FIG. 9. Elements similar to those in the first exemplary embodiment are denoted with the same reference marks, and detailed descriptions of those elements are omitted. The element whose sectional view is not shown is similar to that of FIG. 1.

Figure 6:
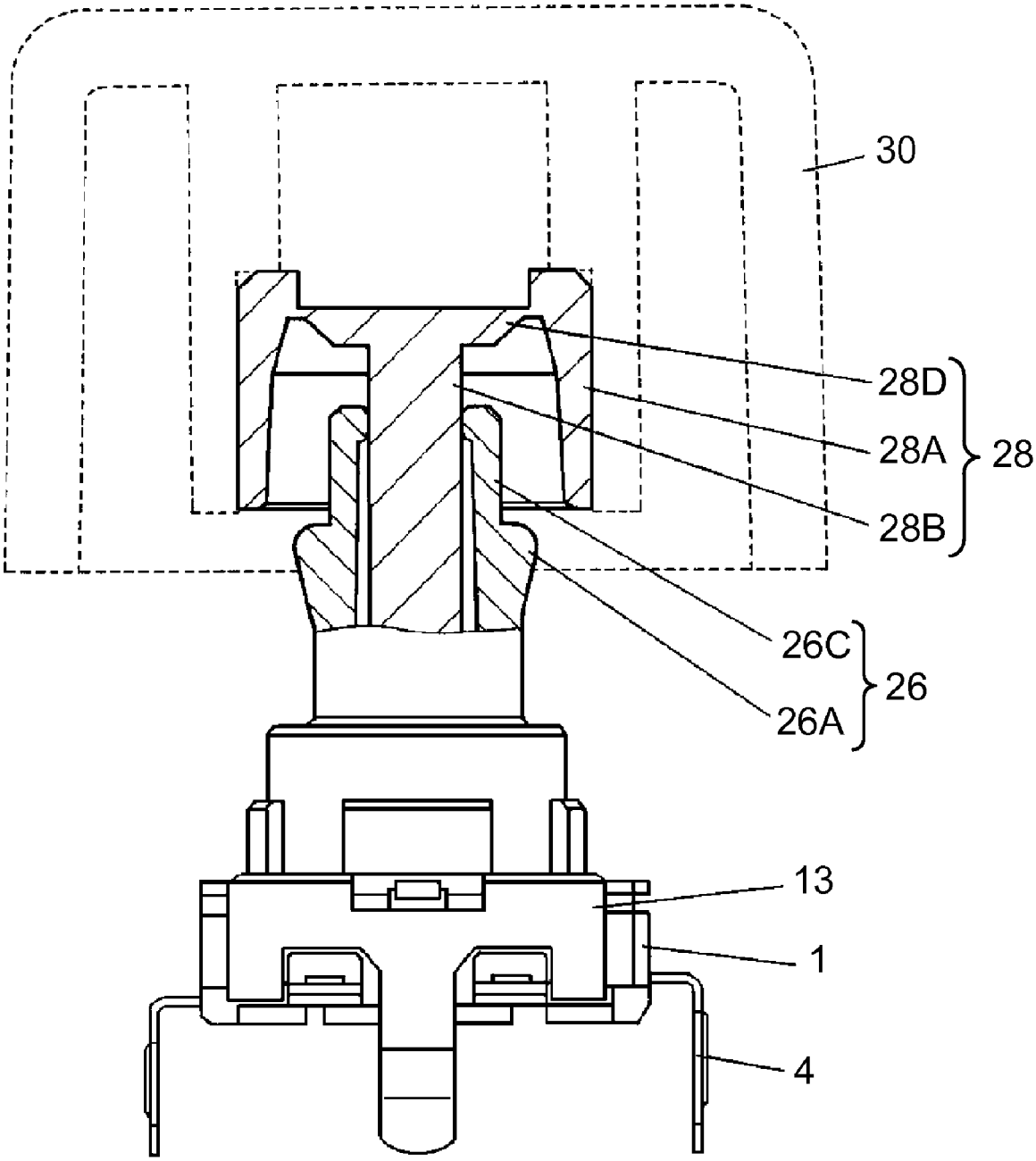
FIG. 6 is a sectional view of an essential part of a rotating operation type encoder as a rotating operation type electronic component in accordance with a second exemplary embodiment of the present invention.

FIG. 6 is a sectional view of an essential part of a rotating operation type encoder in accordance with the second exemplary embodiment of the present invention. In bushing 26, annular building section 26A projects on the entire outer periphery of the position that is lower than the upper end of cylindrical section 26C by a predetermined length. The vertical cross section of annular building section 26A projects in a circular arc shape, the horizontal top position of the circular arc shape has the largest outer diameter, and a part lower than the position is formed as an inclined surface approaching the outer periphery of cylindrical section 26C.

Rotation shaft 28 has substantially cylindrical operation section 28A, intermediate section 28B, and coupling section 28D. Intermediate section 28B projects upward from cylindrical section 26C of bushing 26. Operation section 28A is disposed at the upper end of intermediate section 28B via coupling section 28D. The inner diameter of operation section 28A is set larger than the outer diameter of annular building section 26A of bushing 26. The thinnest part of coupling section 28D is positioned outside the outer diameter of cylindrical section 26C of bushing 26.

The lower end of the inner surface of operation section 28A is set to be lower than the largest outer diameter position of annular building section 26A when rotation shaft 28 moves downward by an operation distance of a push-on switch and arrives at the vertically lowest position. Operation knob 30 shown by the broken lines is mounted on operation section 28A.

In the rotating operation type encoder where no push-on switch is disposed and rotation shaft 28 does not move vertically, the lower end position of the inner surface of operation section 28A is required to be lower than the largest outer diameter position of annular building section 26A in a no-load state.

The operation of the rotating operation type encoder having such a structure of the present embodiment is similar to that of the first embodiment, and thus the operation is not described.

When the rotating operation type encoder is mounted on an on-vehicle electronic device or the like, the electronic device is sometimes mounted on an inclined dash board surface. In this case, when an accident such as vehicle collision occurs, an excessive load is assumed to be applied to operation section 28A from a direction inclined with respect to the axial direction of rotation shaft 28. The case where an excessive load exceeding an assumed level is applied to operation section 28A in such a state is described hereinafter.

Figure 7:
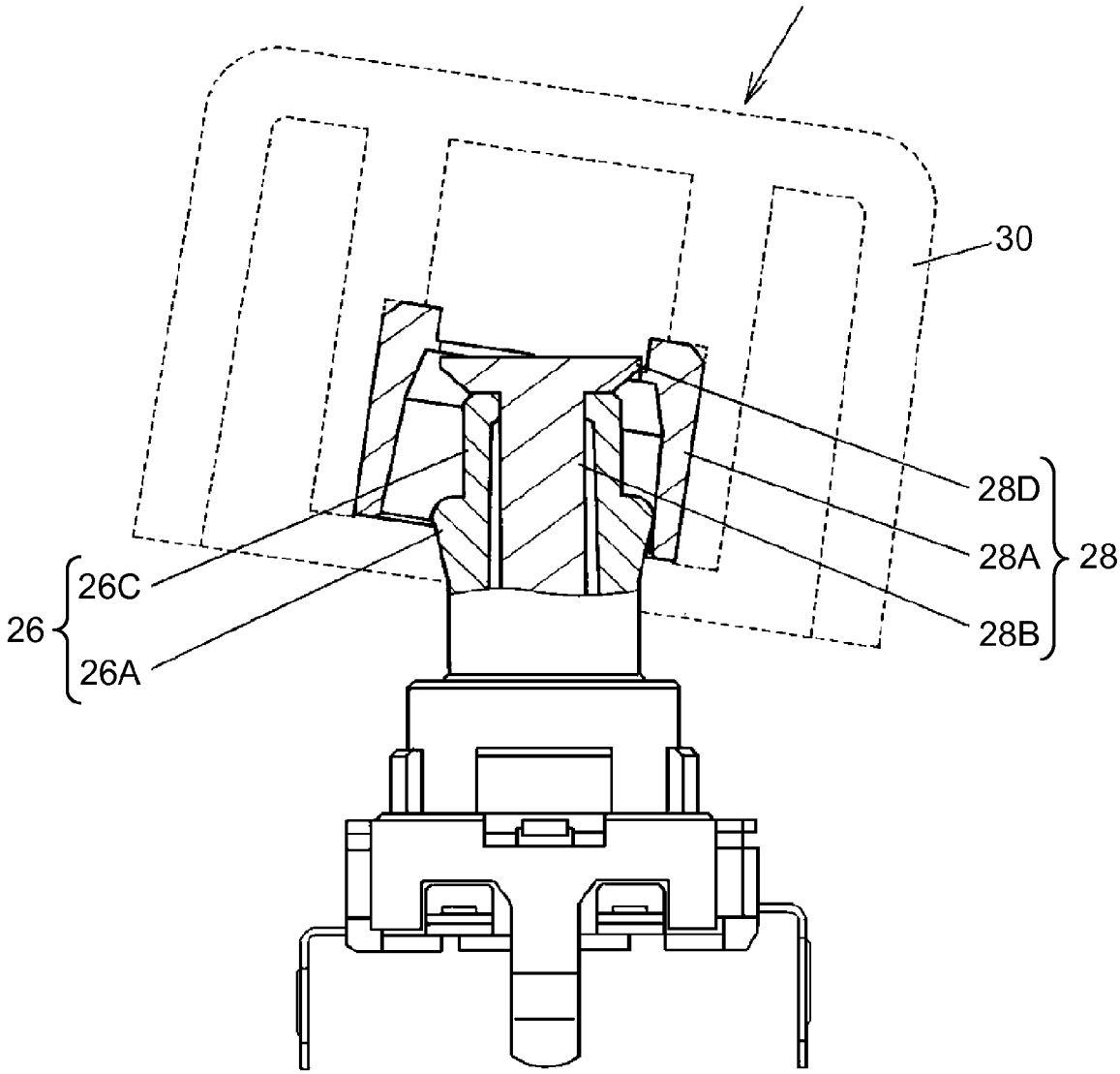
FIG. 7 is a sectional view of an essential part showing a state where a load is applied to the rotating operation type encoder of FIG. 6 from a diagonal direction and a coupling section of the rotation shaft comes close to breaking.
Figure 8:
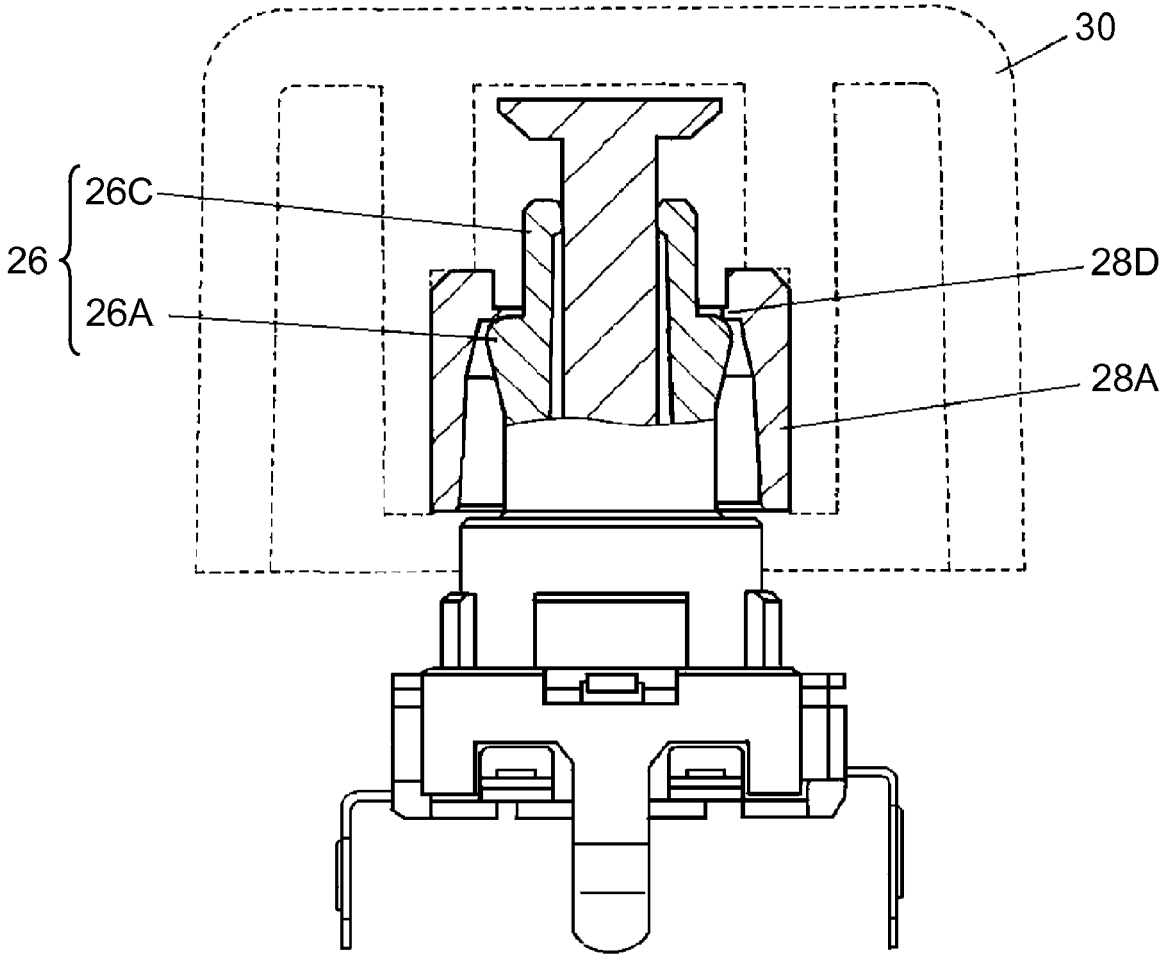
FIG. 8 is a sectional view of an essential part of the rotating operation type encoder showing a state where the coupling section completely breaks after the state of FIG. 7.

FIG. 7 is a sectional view of an essential part of the rotating operation type encoder in the state where coupling section 281) comes close to being broken by a load from a diagonal direction. When a load is applied from the diagonal direction shown by the arrow, this load drops rotation shaft 28 by the operation distance of the push-on switch. Then, coupling section 28D whose mechanical strength is the lowest breaks partially, and simultaneously, the side having undergone the load of operation section 28A drops diagonally with respect to the center of the upper end of intermediate section 28B. The opposite side rises and operation section 28A is inclined.

In this state, the lower end of the inner surface of operation section 28A on the side having undergone the load is positioned under the largest outer diameter position of annular building section 26A of bushing 26. In other words, the inner surface slightly above the lower end of the inner surface of operation section 28A abuts on the inclined surface on the lower side of annular building section 26A. Here, the inclined surface on the lower side of annular building section 26A is set in an inclined state where the lower end of the inner surface of operation section 28A does not abut.

When a load is further applied, coupling section 28D having broken partially breaks completely, thereby separating operation section 28A from intermediate section 28B. Operation section 28A drops down while the contacting part on the inner periphery of operation section 28A slides on the inclined surface on the lower side of annular building section 26A. Also at this time, the lower end of the inner surface of operation section 28A does not abut on the lower inclined surface, so that operation section 28A moves smoothly.

Coupling section 28D is set so that it completely breaks outside the outer diameter of cylindrical section 26C of bushing 26. Ultimately, as shown in the sectional view of the essential part of FIG. 8, cylindrical section 26C projects above operation section 28A, and the outer peripheral surface of breaking coupling section 281) abuts on annular building section 26A. In this state, the downward movement of operation knob 30 and operation section 28A stops.

Annular building section 26A is projected at a position lower than the upper end of cylindrical section 26C by a predetermined size so that the dropping distance of operation knob 30 of the electronic device mounted with the encoder is secured.

In order to secure this dropping distance, relevant dimensions may be set so that the breaking position of coupling section 28D exists outside the largest outer diameter of annular building section 26A. Similarly to the first embodiment, a step section may be provided on bushing 26. In this case, the lower end of dropping operation section 28A abuts on the step section of bushing 26, thereby stopping operation section 28A.

As described above, also when operation section 28A is inclined and coupling section 28D is broken by the excessive load applied from the direction inclined with respect to the axial direction of rotation shaft 28, coupling section 28D is broken completely and operation section 28A drops. In other words, a part other than the lower end of the inner surface of operation section 28A abuts on the lower inclined surface of annular building section 26A and slips downward. Therefore, the lower end of the inner surface of operation section 28A does not bite into the outer peripheral surface of bushing 26.

Figure 9:
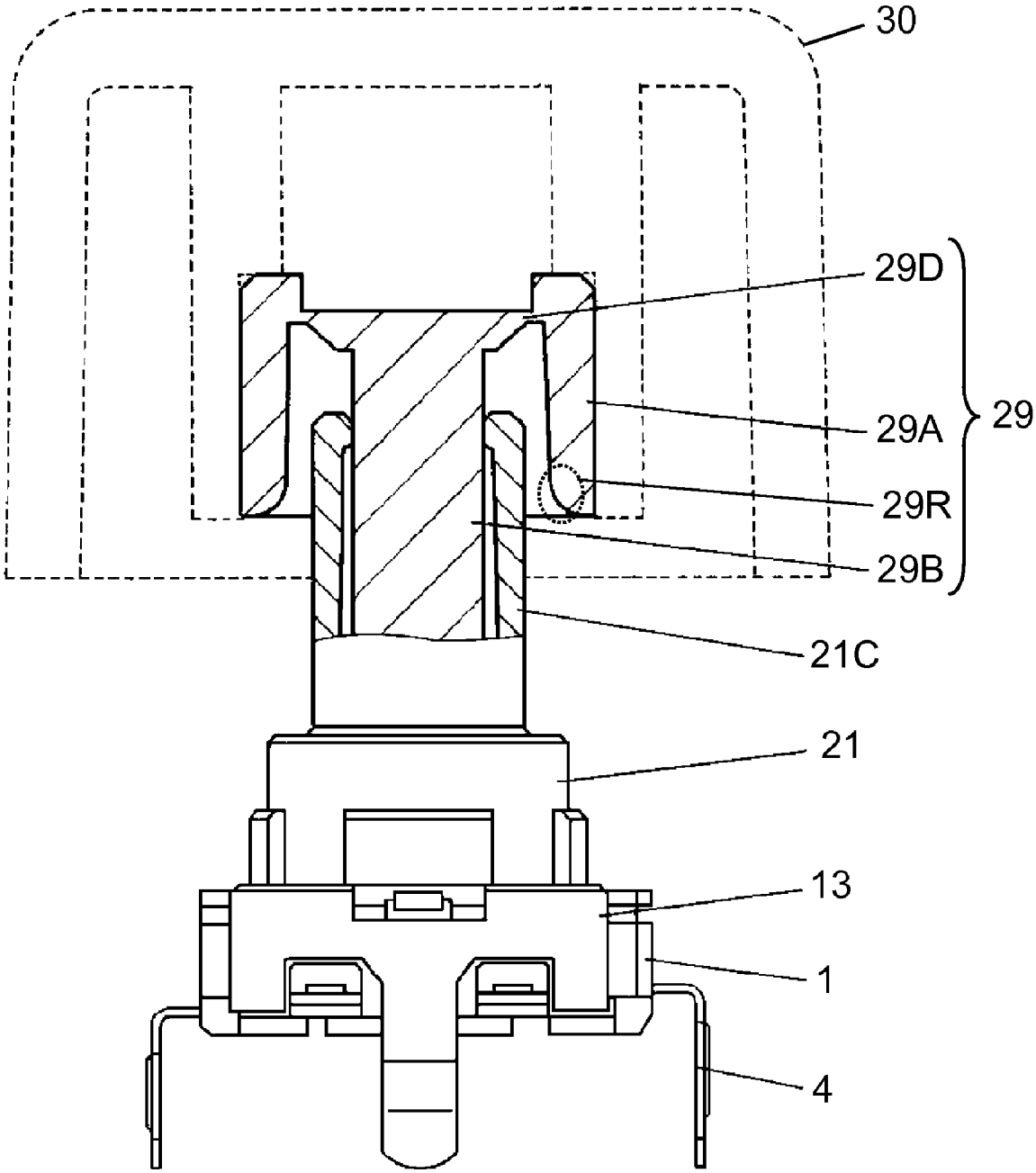
FIG. 9 is a sectional view of an essential part of another rotating operation type encoder as a rotating operation type electronic component in accordance with the second exemplary embodiment.

Instead of the structure where annular building section 26A of bushing 26 is projected, the structure shown in the sectional view of the essential part of FIG. 9 may be acceptable. Rotation shaft 29 has operation section 29A, intermediate section 29B, and coupling section 29D. Operation section 29A is coupled to the upper end of intermediate section 29B via coupling section 29D. Circular-arc chamfer 29R is provided at the lower end of the inner surface of operation section 29A. The other elements are similar to those of the first embodiment.

Also in this structure, when operation section 29A is inclined and coupling section 29D is broken by the excessive load applied from the direction inclined with respect to the axial direction of rotation shaft 29, coupling section 29D is broken completely and operation section 29A drops. In other words, even when the lower end of the inner surface of operation section 29A abuts on the outer peripheral surface of cylindrical section 21C, circular-arc chamfer 29R is provided at the lower end. Therefore, the lower end of the inner surface of operation section 29A slips downward without biting into the outer peripheral surface of cylindrical section 21C.

Figure 10:
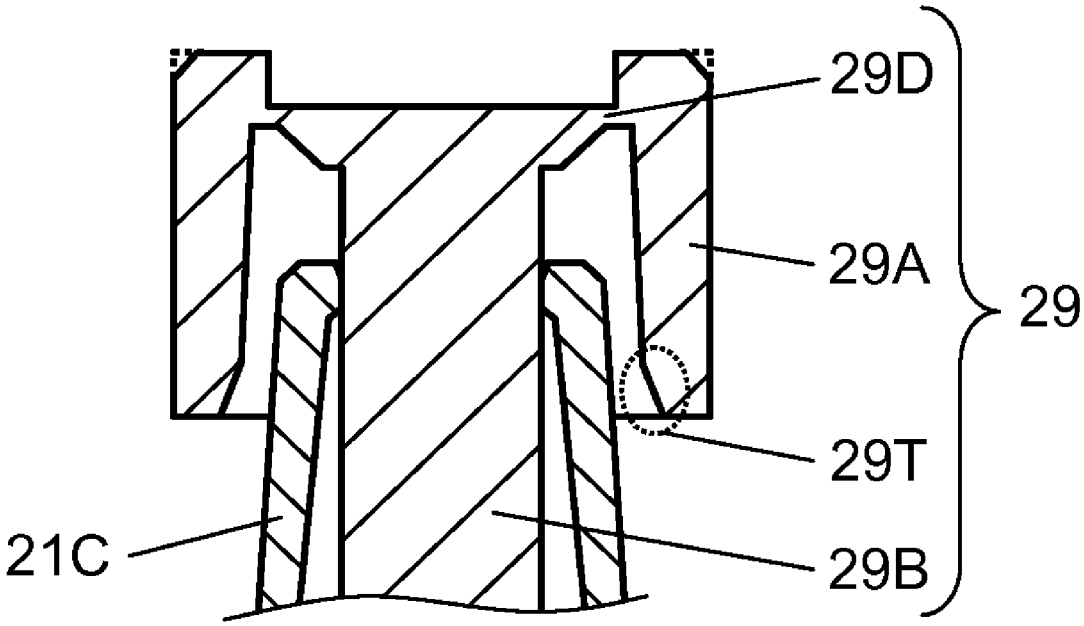
FIG. 10 is a sectional view of an essential part of yet another rotating operation type encoder as a rotating operation type electronic component in accordance with the second exemplary embodiment.
Figure 11:
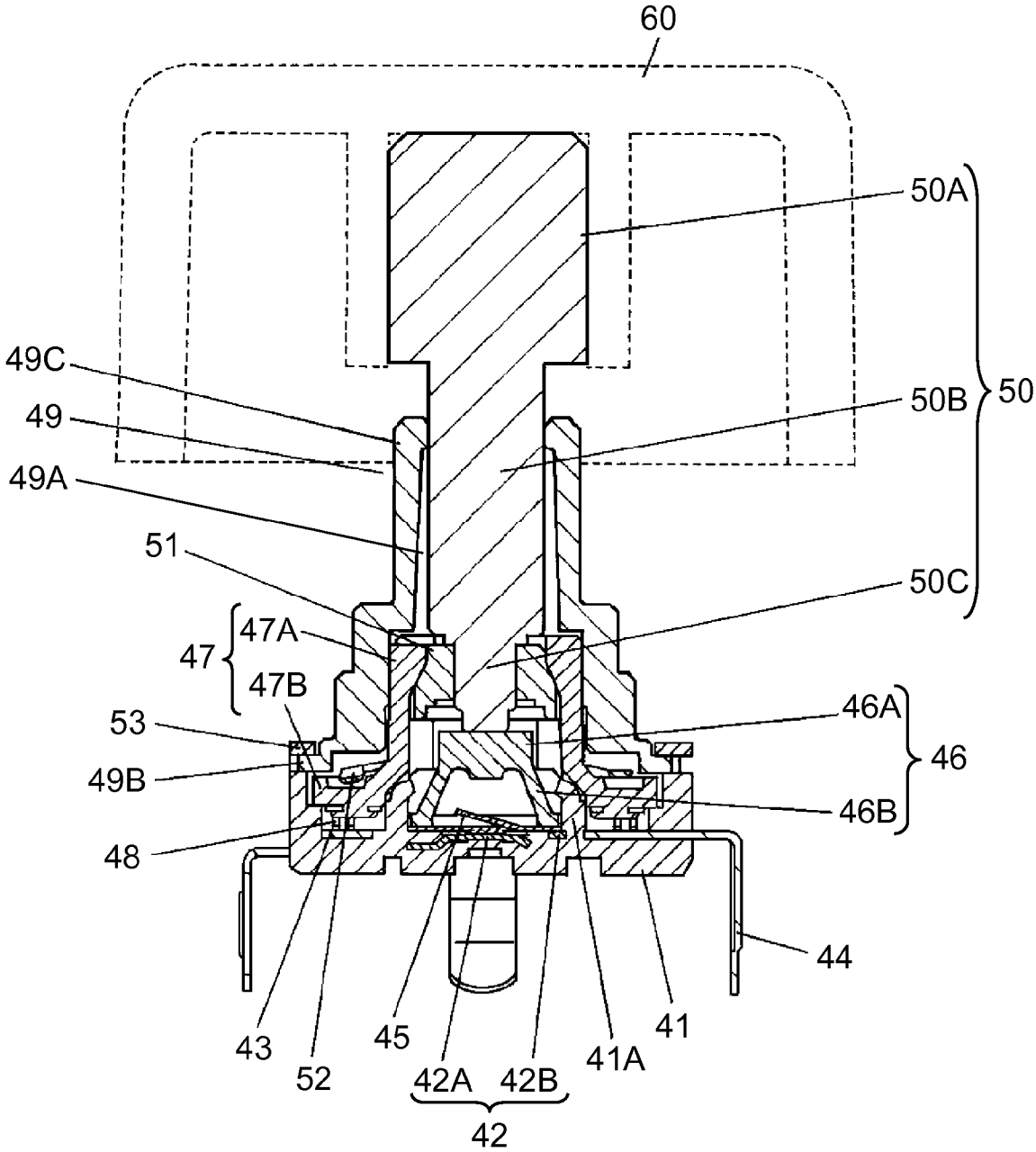
FIG. 11 PRIOR ART
FIG. 11 is a sectional view of a conventional rotating operation type encoder.

As shown in the sectional view of the essential part of FIG. 10, inclined surface 29T may be provided at the lower end of the inner surface of operation section 29A of rotation shaft 29. The inclined angle of inclined surface 29T is required to be set substantially equal to the inclination of operation section 29A occurring when coupling section 29D is broken partially by the excessive load applied from an inclined direction, operation section 29A is inclined, and the lower end of the inner surface of operation section 29A abuts on the outer peripheral surface of cylindrical section 21C. In this structure, inclined surface 29T comes into contact with the outer peripheral surface of cylindrical section 21C and slips downward. When coupling section 29D is broken completely, operation section 29A drops down.

As described in the first embodiment using FIG. 5, in any of these structures mentioned above, the rotation shaft may be formed by die-casting and the upper surface of the operation section may be flat.

The present invention is not limited to application to only a rotating operation type encoder having a push-on switch described above. The present invention can be wholly applied to a rotating operation type encoder allowing only rotating operation, or the other rotating operation type electronic components such as a rotating operation type variable resistor. In addition, the present invention can be applied to a structure where an operation knob is attached to the operation section even when the structure is not of a rotating operation type.

As discussed above, in the rotating operation type electronic component of the present invention and the electronic device mounted with it, the operation section of the rotating operation type electronic component drops when an excessive load of a predetermined level or higher is applied. Therefore, the dropping distance of the operation knob of the electronic device mounted with the rotating operation type electronic component can be secured. This rotating operation type electronic component is useful for an input operation section of an on-vehicle electronic device such as a car audio device.

What is claimed is:

1. An electronic component comprising:

a rotation shaft including a rod-shaped intermediate section, a rotatable cylindrical operation section covering an upper part of the intermediate section and capable of being mounted with an operation knob, and a coupling section coupling an upper end of the intermediate section with the operation section;

a signal generating section configured to generate an electric signal in response to rotation of the operation section; and a bushing having a cylindrical section supporting the intermediate section;

wherein the coupling section has strength at which the coupling section breaks when a load of a predetermined level or higher is applied to the operation section from an axial direction of the rotation shaft;

wherein the upper end of the intermediate section projects from the bushing;

wherein an inner diameter of a part of the operation section that is coupled to the intermediate section via the coupling section is larger than an outer diameter of the cylindrical section; and wherein vertical thickness of the coupling section is smallest at a position outside an outer periphery of the cylindrical section.

2. The electronic component according to claim 1, wherein an annular building section has a vertical cross section that projects in a circular arc shape, the annular building section being provided on an entire outer periphery of the cylindrical section, at a position lower than an upper end of the bushing by a predetermined length, an inner diameter of the operation section is larger than an outer diameter of the annular building section, a lower end of an inner surface of the operation section is positioned at a position lower than a position of the annular building section where the outer diameter is the largest, at a lower end position of vertical movement of the rotation shaft, and a vertical thickness of the coupling section is smallest at a position outside an outer periphery of the cylindrical section above the annular building section.

3. The electronic component according to claim 1, wherein either a circular-arc chamfer is provided at a lower end of an inner surface of the operation section, or an inclined surface is provided at a lower end of an inner surface of the operation section at an angle substantially equal to inclination of the operation section occurring when the coupling section breaks partially and the lower end of the inner surface of the operation section comes in contact with the cylindrical section of the bushing.

4. An electronic device comprising:

an electronic component having a rotation shaft including a rod-shaped intermediate section, a rotatable cylindrical operation section covering an upper part of the intermediate section, and a coupling section coupling an upper end of the intermediate section to the operation section, and a signal generating section configured to generate an electric signal in response to rotation of the operation section, wherein the coupling section has strength at which the coupling section breaks when a load of a predetermined level or higher is applied to the operation section from an axial direction of the rotation shaft;

an operation knob mounted on the operation section; and a circuit section coupled to the signal generating section, wherein a recessed section that is open downwardly and has a step section is disposed in a center of the operation knob, a part of the recessed section positioned under the step section is engaged with the operation section, and an inner diameter of the recessed section above the step section is larger than an outer diameter of the coupling section.

5. The electronic device according to claim 4, wherein the electronic component further has a bushing having a cylindrical section supporting the intermediate section, and the inner diameter of the recessed section above the step section is larger than an inner diameter of the operation section.

6. An electronic component comprising:

a rotation shaft including a rod-shaped intermediate section, a rotatable cylindrical operation section covering an upper part of the intermediate section and capable of being mounted with an operation knob, and a coupling section coupling an upper end of the intermediate section with the operation section; and a signal generating section configured to generate an electric signal in response to rotation of the operation section, wherein the coupling section has a thinnest part constituting a breaking part, or the coupling section is provided with through-holes at constant intervals, so that the coupling section has strength at which the coupling section breaks when a load of a predetermined level or higher is applied to the operation section from an axial direction of the rotation shaft.

7. An electronic device comprising:

an electronic component having a rotation shaft including a rod-shaped intermediate section, a rotatable cylindrical operation section covering an upper part of the intermediate section, and a coupling section coupling an upper end of the intermediate section to the operation section, and a signal generating section configured to generate an electric signal in response to rotation of the operation section, wherein the coupling section has a thinnest part constituting a breaking part, or the coupling section is provided with through-holes at constant intervals, so that the coupling section has strength at which the coupling section breaks when a load of a predetermined level or higher is applied to the operation section from an axial direction of the rotation shaft;

an operation knob mounted on the operation section; and a circuit section coupled to the signal generating section.

8. The electronic device according to claim 7, wherein the coupling section is provided with said through-holes at constant intervals.

9. The electronic device according to claim 8, wherein said through-holes are circumferentially spaced apart at said constant intervals.

10. The electronic device according to claim 7, wherein said coupling section has said thinnest part constituting said breaking part; and said thinnest part is constituted by a ring-shaped thinnest part of said coupling section of said rotation shaft.

11. The electronic component according to claim 6, wherein the coupling section is provided with said through-holes at constant intervals.

12. The electronic component according to claim 11, wherein said through-holes are circumferentially spaced apart at said constant intervals.

13. The electronic component according to claim 6, wherein said coupling section has said thinnest part constituting said breaking part; and said thinnest part is constituted by a ring-shaped thinnest part of said coupling section of said rotation shaft.

* * * * *